United States Patent [19]

Bryant et al.

[11] Patent Number: 4,832,056

[45] Date of Patent: May 23, 1989

[54] APPARATUS FOR MAKING CIGARETTES

[75] Inventors: Raymond A. Bryant, Yatton; Beresford R. Gill, Paulton; Stephen J. Garrett, Somerton; Christopher R. Bale, Keynsham, all of England

[73] Assignee: Imperial Tobacco Limited, Bristol, England

[21] Appl. No.: 19,133

[22] Filed: Feb. 25, 1987

[30] Foreign Application Priority Data

Feb. 25, 1986 [GB] United Kingdom ..... 8604655

[51] Int. Cl.[4] ..... A20C 5/40

[52] U.S. Cl. ..... 131/58; 131/73; 131/75; 131/77

[58] Field of Search ..... 131/77, 58, 73, 75

[56] References Cited

U.S. PATENT DOCUMENTS 2,868,209 11/1959 Marcotte ..... 131/58

4,233,994 11/1980 Sass ..... 131/58

4,534,367 8/1985 Newsome ..... 131/58

*Primary Examiner*—V. Millin

*Attorney, Agent, or Firm*—Larson and Taylor

[57] ABSTRACT

A hand operated device for applying cigarette paper to a preformed tobacco rod comprises a forming roller arranged to rotate the rod about its longitudinal axis, a mechanical applicator for applying a pregummed sheet of cigarette paper to the rod as the rod is rotated about its axis, wherein the forming roller is provided along its length with a pair of circumferential helical grooves of opposite chirality, there being further provided a manually operable spigot device adapted to cooperate with the grooves and constrained to travel linearly parallel to the axis of the roller whereby manual movement of the spigot in either linear direction rotates the roller in a constant angular direction.

9 Claims, 2 Drawing Sheets

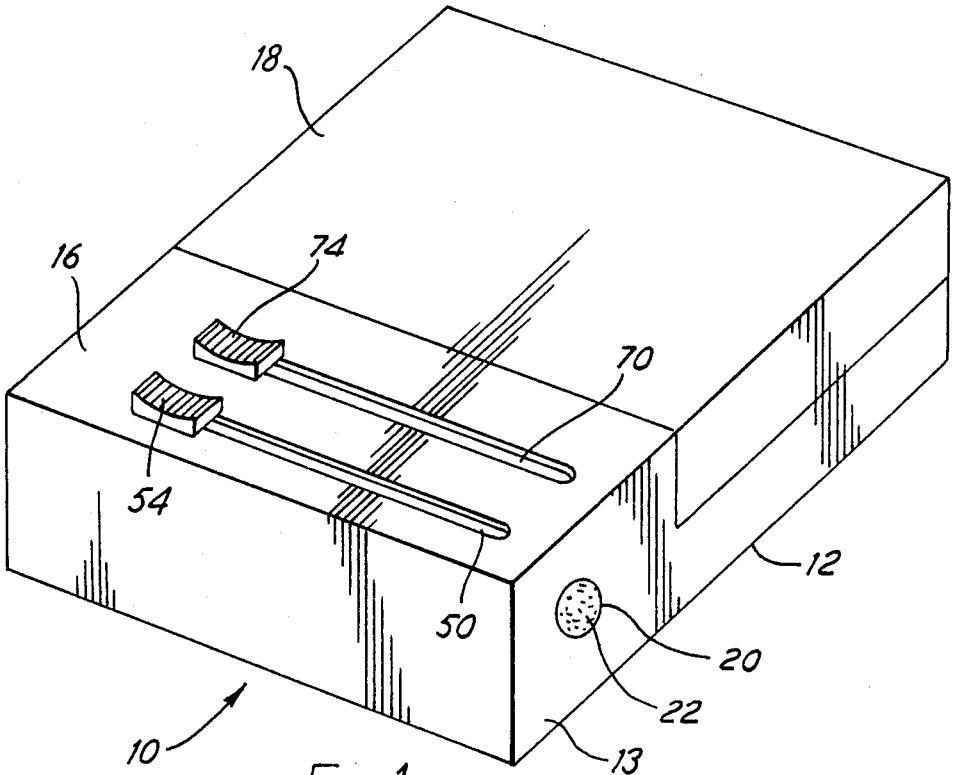
FIG. 1
FIG. 5
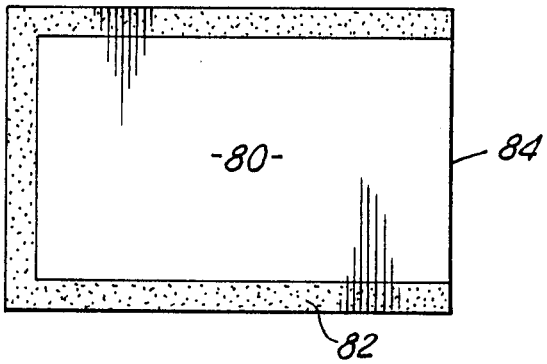

APPARATUS FOR MAKING CIGARETTES

This invention relates to an apparatus for making cigarettes. In particular, the invention relates to a hand operated device for enabling a smoker to make cigarettes using supplied preformed tobacco rods and filter components, and enables a user to make easily by hand a number of cigarettes in, for instance, a domestic or office environment.

"Smoking material" in this specification will be understood to include not only tobacco, but a non-tobacco smoking material, or any combination of a non-tobacco smoking material with tobacco. Non-smokeable additives and flavours may be included in the smoking material.

According to the present invention there is provided a hand operated device for applying wrapping paper to a cylindrical smoking article, the device comprising, (a) means for supporting the article within the device,
(b) a forming roller lying axially parallel to and in contact with the article, whereby rotation of the forming roller rotates the article about its longitudinal axis,
(c) mechanical means for applying a pregummed sheet of wrapping paper to the article as the article is rotated about its axis, and
(d) mechanical means for synchronising the rotation of the article with the means for applying the wrapping paper, characterised in that the forming roller is provided along its length with a pair of circumferential helical grooves of opposite chirality, there being provided a manually operable spigot means adapted to cooperate with said grooves and constrained to travel linearly parallel to the axis of the roller whereby manual movement of the spigot in either linear direction rotates the roller in a constant angular direction.

Preferably the ends of one groove are joined to the respective ends of the other groove to provide transfer grooves at the respective ends of the forming roller whereby the spigot means transfers from one groove to the other when it reaches an end of its linear travel.

Preferably the means for supporting the article within the device comprises a tube adapted to receive the article, the tube being provided with a first longitudinal slot arranged to permit rotation of the forming roller to be copied to the article when within the tube, and a second longitudinal slot arranged to permit the application of said pregummed sheet of wrapping paper to the article when within the tube.

The arrangement of the first slot is preferably such that a portion of the circumference of the forming roller projects through said first slot onto the article.

The means for applying the pregummed sheet of wrapping paper to the article preferably includes a pressure roller lying axially parallel to the article and arranged to press the sheet through the second slot against the article.

The pregummed sheet of wrapping paper is preferably in the form of pre-cut patches held on a film release substrate carried on a pair of bobbins, one bobbin being a take-up bobbin, configured as a cartridge for insertion within the device.

The means for synchronising the rotation of the article with the means for applying the wrapping paper to the article is preferably provided by intermediate gearing means in operative cooperation with the forming roller and the take-up bobbin, thereby also providing means to rotate the take-up bobbin.

The device may be provided with a storage area for a plurality of said articles prior to being wrapped.

Each article may comprise a preformed cylindrical rod of smoking material, or the combination of such a rod with a plug of filter material adapted to abut an end of the rod.

The invention is particularly useful for wrapping preformed rods of smoking material that in the unwrapped state are inherently unsmokeable but which, when wrapped in cigarette paper, provide smokeable cigarettes.

The preformed rods of smoking material for use by the apparatus of the invention are preferably made of a smoking material such as any tobacco (cigarette, cigar, pipe or hand-rolling) intended for smoking that is formed in such a way that it is inherently incapable of being smoked until it has been overwrapped. Such preformed rods will be self-supporting and may be provided in a number of ways.

For example, smoking tobacco (which may be cut or threshed by methods known in the art) may be wrapped in a highly porous open structured paper such as teabag tissue. The product so formed will be inherently unsmokable until it has been overwrapped in cigarette paper.

Teabag tissue is a coarse woven cellulosic web consisting of a pattern of thin areas, which in this context we shall refer to as "apertures". Typically, a teabag tissue may have about 25 "apertures" in a rectangular or diamond-shaped array per square centimetre, each "aperture" having dimensions of about 1 mm×1 mm. The typical thickness of a teabag tissue "aperture" is 1 fibre, the regions of the web separating the "apertures" being several fibres thick. The teabag tissue may be strengthened by means of strips or strings of strengthening materials such as cotton, plastics, or impermeable paper, or may be replaced by any of the following:

(a) Impermeable or permeable paper that has been heavily mechanically perforated;
(b) Tobacco sheet formed by known processes that has been heavily mechanically perforated;
(c) Plastics (e.g. polyolefine) or natural fibre (e.g. cotton) net; or,
(d) A film of adhesive.

Alternatively, the smoking material may be moulded, pressed, pelleted or extruded with carboxymethyl cellulose or starch to form a self-supporting rod that is inherently unsmokeable until it has been overwrapped.

Yet again, the product may be formed on a cigarette making machine by applying a hot melt adhesive to the smoking material and then passing the smoking material through a hot garniture to set the adhesive. Again, the product is inherently unsmokeable until it has been overwrapped.

The invention will now be described by way of example only with reference to the accompanying non-scale diagrammatic drawings in which, FIG. 1 is an oblique perspective view of a hand operated device for applying wrapper to the combination of a tobacco rod and a filter plug;

FIG. 5 shows a configuration of gum lines on cigarette wrapping paper for use in the invention.

Figure 2:
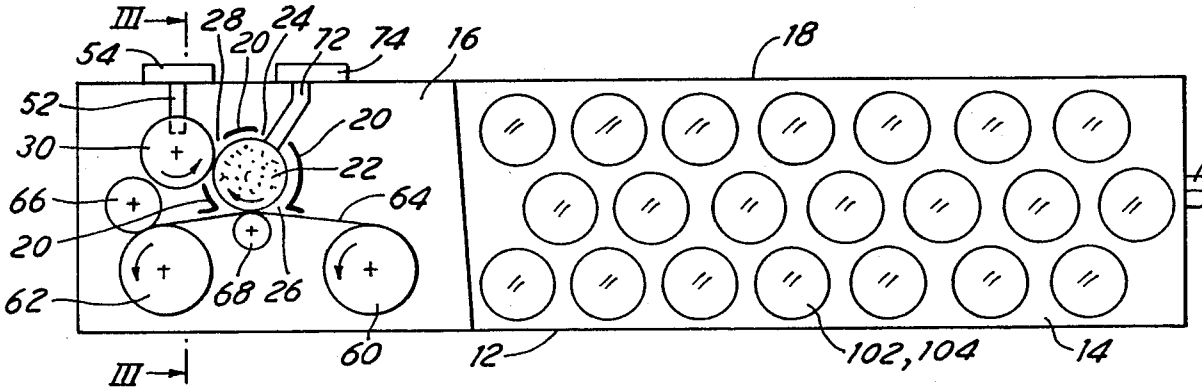
FIG. 2 is a vertical section through the device of FIG. 1.
Figure 3:
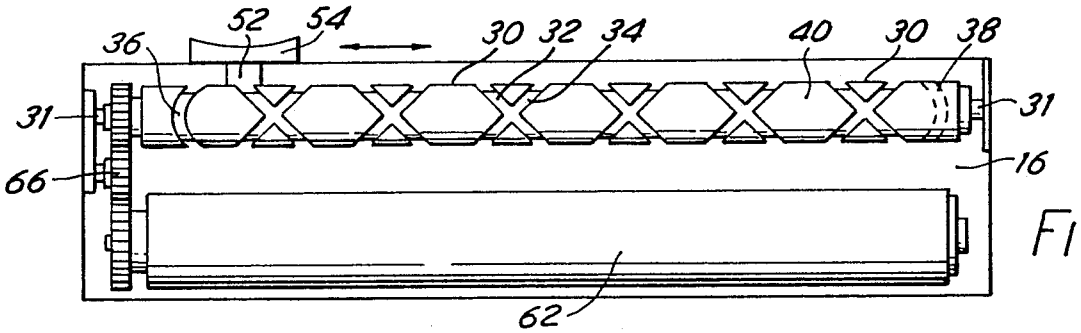
FIG. 3 is a vertical section through the device of FIG. 1 taken along the line III—III of FIG. 2.

Referring to FIGS. 1 to 3, there is shown a manually operable device 10 for enabling a smoker to apply cigarette wrapping paper to a preformed rod of tobacco and filter plug in order to make a cigarette. The device 10 is in the form of a box 12 divided into compartments 14,16.

Compartment 14 provides storage space for a set 100 of preformed tobacco rods together with filter plugs, and is provided with a hinged lid 18 attached to the box 12 by hinge 19.

Compartment 16 contains a cartridge of pregummed sheets of cigarette wrapping paper, means to support and rotate a combined preformed tobacco rod together with an abutting filter plug about a common longitudinal axis, and means to transfer a pregummed sheet of cigarette wrapping paper from the cartridge onto the tobacco rod and filter plug so as to make a smokeable cigarette.

Inside compartment 16 there is provided a tube 20 adapted to contain and support in end-to-end abutment a preformed tobacco rod and filter plug combination 22. One end of the tube 20 opens onto a side wall 13 of the box 12 so that a user may slide a tobacco rod and filter plug into the tube. The tube 20 is further provided with three longitudinal slots 24, 26, 28, the purposes of which will be explained hereinafter, extending over a substantial portion of its length.

A forming roller 30 mounted on axial bearings 31 is provided lying axially parallel to the tube 20 within compartment 16. The cylindrical surface of the roller 30 is provided along its length with a pair of circumferential helical grooves 32, 34 of opposed chirality or handedness. Such a pair of helical grooves of opposite chirality is termed enantiocheiric. Each end of groove 32 joins to the respective end of groove 34 to provide transfer grooves 36, 38 at the respective ends of roller 30 that extend partly round the periphery of the roller.

The roller 30 lies sufficiently close to the tube 20 so that lands 40 between the grooves 32, 34 project through slot 28 into the tube so as to contact the periphery of the tobacco rod/filter plug combination 22 within the tube. Hence, the rotation of the forming roller 30 will be copied onto the tobacco rod/filter plug combination 22 within the tube and bring about a consequential rotation of the combination.

In upper face 15 of box 12 there is provided a first linear slot 50 communicating with compartment 16 and lying directly over and parallel to the axis of roller 30. A spigot 52, provided at its upper end with a finger pad 54, is constrained to travel linearly in slot 50. The lower end of the spigot 52 is also constrained to slide in one or the other of the grooves 32, 34 in the roller 30. Thus, the constraints imposed on the spigot 52 by slot 50 and the enantiocheiric grooves 32, 34 will result in rotation of the roller 30 when the user moves the spigot by means of the finger pad 54.

If the spigot 52 is in enantiocheiric groove 34 and is moved so that it travels from left to right (with reference to FIG. 3) the roller 30 will rotate anticlockwise, as shown in FIG. 3. When the spigot 52 reaches the end of its travel from left to right in groove 34 it moves into transfer groove 38. On leaving transfer groove 38 the spigot 52 transfers to the other enantiocheiric groove 32, and, on being moved from right to left (FIG. 3) will continue to rotate the roller 30 anticlockwise (FIG. 2). A similar transfer back to enantiocheiric groove 34 takes place when the spigot 52 reaches the other transfer groove 36 at the left hand end of the roller 30 (FIG. 3), and the roller is thus enabled to rotate in a constant angular direction irrespective of the linear direction of movement of the spigot.

Located within compartment 16, underneath, either side of, and axially parallel to the tube 20, is a pair of bobbins 60, 62 which are configured as a cartridge for ease of insertion into the compartment. Bobbin 60 is initially filled with a roll of cigarette wrapping paper consisting of individual pre-cut and pre-gummed sheets of cigarette paper 80 (FIG. 5) held on a film release substrate web 64. Bobbin 62 is a take-up bobbin for the used substrate web 64 when the sheets of cigarette paper 80 have been removed and is driven from the forming roller 30 by an intermediate gear wheel 66. The run of the substrate 64 between the bobbins 60, 62 is pressed against the tobacco rod/filter plug combination 22 in tube 20 through slot 26 in the tube by means of a free-running pressure roller 68.

A second linear slot 70 is provided in the upper face 15 of box 12 parallel to slot 50 and also communicating with compartment 16. There is provided a second spigot 72 adapted to slide in slot 70 and arranged to project through slot 24 in tube 20 and abut that end of the tobacco rod/filter plug combination 22 remote from side wall 13 so that movement of spigot 72 towards side wall 13 will eject the tobacco rod/filter plug combination from the device. This ejection is facilitated by a finger pad 74 attached to the upper end of spigot 72.

Figure 4:
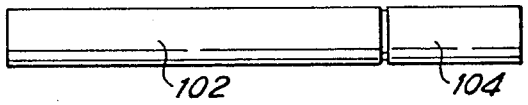
FIG. 4 is a side view of a preformed tobacco rod and filter plug for use in the invention.

Referring to FIG. 4 there is shown a preformed tobacco rod 102 and filter plug 104 forming part of the set 100 referred to above. Each tobacco rod 102 within the compartment 16 is preferably in end-to-end relationship with its corresponding filter plug 104, but other arrangements may be used if necessary.

In FIG. 5 there is shown one of the sheets of cigarette paper 80 referred to above. It is of rectangular shape and is provided with a gum line 82 of adhesive adjacent three of its edges. Each sheet 80 is positioned on the substrate web 64 such that in use the edge 84 of the sheet 80 that does not have an adjacent gum line will be aligned with the mouth end of the filter plug 104 when the sheet 80 is fed onto the tobacco rod 102/filter plug 104 combination.

In operation of the device, an aforesaid set 100 of preformed tobacco rods and filter plugs is stored in compartment 14, and a cartridge (bobbins 60, 62) of pregummed sheets of cigarette paper 80 is placed in compartment 16, as shown in FIG. 2.

A preformed tobacco rod 102 and a filter plug 104 are removed from the set 100 and inserted in tube 20 so that the tobacco rod and filter plug abut within the tube to form the tobacco rod/filter plug 22 combination.

Manual movement of spigot 52 along slot 50 causes the forming roller 30 to rotate. The rotation of roller 30 brings about rotation of the tobacco rod/filter plug combination 22 and drives the take-up bobbin 62 so that a pre-gummed web of cigarette paper 80 carried on substrate web 64 is pressed against the tobacco rod/filter plug combination 22 and is transferred thereto by the pressure roller 68 to form a wrapped cigarette which is then ejected by spigot 72.

The spacing of the cigarette paper webs 80 on the substrate 64, the pitch of the helical grooves 32, 34, and the gearing between the forming roller 30, tobacco rod/filter plug combination 22, and take-up bobbin 62 are chosen such that one pre-gummed web of cigarette paper 80 is applied to the combination during one revolution of the combination in tube 20.

The invention enables a domestic user to make as many cigarettes of high quality as he wishes for his own use in a continuous automated manner, requiring only the initial loading of a supply of rods and sheets of matching cigarette paper. The invention avoids the need for complex equipment using fluted drums in which cigarette paper is inserted in the flutes before the tobacco is inserted.

We claim:

1. A hand operated device for applying wrapping paper to a cylindrical smoking article, the device comprising, (a) means for supporting the article within the device, (b) a forming roller lying axially parallel to and in contact with the article, whereby rotation of the forming roller rotates the article about its longitudinal axis, (c) mechanical means for applying a pregummed sheet of wrapping paper to the article as the article is rotated about its axis, and (d) mechanical means for synchronising the rotation of the article with the means for applying the wrapping paper, characterised in that the forming roller is provided along its length with a pair of circumferential helical grooves of opposite chirality, there being provided a manually operable spigot means adapted to cooperate with said grooves and constrained to travel linearly parallel to the axis of the roller whereby manual movement of the spigot in either linear direction rotates the roller in a constant angular direction.

2. A device as claimed in claim 1 characterised in that the ends of one groove are joined to the respective ends of the other groove to provide transfer grooves at the respective ends of the forming roller whereby the spigot means transfers from one groove to the other when it reaches an end of its linear travel.

3. A device as claimed in claim 1 wherein the means for supporting the article within the device comprises a tube adapted to receive the article, the tube being provided with a first longitudinal slot arranged to permit rotation of the forming roller to be copied to the article when within the tube, and a second longitudinal slot arranged to permit the application of said pregummed sheet of wrapping paper to the article when within the tube.

4. A device as claimed in claim 3 wherein the arrangement of the first slot is such that a portion of the circumference of the forming roller projects through said first slot onto the article.

5. A device as claimed in claim 3 wherein the means for applying the pregummed sheet of wrapping paper to the article includes a pressure roller lying axially parallel to the article and arranged to press the sheet through the second slot against the article.

6. A device as claimed in claim 1 wherein the pregummed sheet of wrapping paper is in the form of precut patches held on a film release substrate carried on a pair of bobbins, one bobbin being a take-up bobbin, configured as a cartridge for insertion within the device.

7. A device as claimed in claim 1 wherein means for synchronising the rotation of the article with the means for applying the wrapping paper to the article is provided by intermediate gearing means in operative cooperation with the forming roller and the take-up bobbin, thereby also providing means to rotate the take-up bobbin.

8. A device as claimed in claim 1 wherein the device is provided with a storage area for a plurality of said articles prior to being wrapped.

9. A device as claimed in claim 1 wherein each article comprises a preformed cylindrical rod of smoking material, or the combination of such a rod with a plug of filter material adapted to abut an end of the rod.

* * * * *